US005782063A

United States Patent [19]

Boriani et al.

[11] Patent Number: 5,782,063

[45] Date of Patent: Jul. 21, 1998

[54] METHOD FOR OVERWRAPPING PACKETS OF CIGARETTES

[75] Inventors: Silvano Boriani; Antonio Gamberini, both of Bologna, Italy

[73] Assignee: G.D. S.P.A., Bologna, Italy

[21] Appl. No.: 734,535

[22] Filed: Oct. 21, 1996

[30] Foreign Application Priority Data

Oct. 20, 1995 [IT] Italy ..... B095A0502

[51] Int. Cl.[6] ..... B65B 11/00

[52] U.S. Cl. ..... 53/466; 53/228; 53/230; 53/223; 53/220

[58] Field of Search ..... 53/228, 234, 230, 53/222, 223, 586, 464, 466, 399, 436, 220, 556, 526, 528

[56] References Cited

U.S. PATENT DOCUMENTS

| | | | |
|---|---|---|---|
| 3,511,014 | 5/1970 | Kochalski | 53/466 |
| 3,552,088 | 1/1971 | Niwa | 53/230 |
| 4,156,333 | 5/1979 | Mayer | 53/223 |
| 5,133,173 | 7/1992 | Draghetti et al. | 53/466 |
| 5,189,864 | 3/1993 | Cinotti et al. | 53/466 |
| 5,285,621 | 2/1994 | Ballestrazzi et al. | 53/556 |

*Primary Examiner*—John Sipos
*Assistant Examiner*—John Paradiso
*Attorney, Agent, or Firm*—IP Group of Pillsbury Madison & Sutro LLP

[57] ABSTRACT

A method of overwrapping packets of cigarettes is implemented utilizing a machine by which packets and respective sheets of wrapping material are fed singly and in timed succession to a folding station where each packet is directed against a central portion of the corresponding sheet and advanced together with the sheet through a tubular duct of proportions such that the sheet is constrained to fold into a U formation around the packet. To optimize the folding action, the duct is fashioned with two longer side walls of convex profile by which the two lateral portions of the sheet flattened over the main lateral faces of the respective packet are engaged and compressed only along a limited central band of their full advancing width, and caused as a result to spread gradually into uniform contact with the overwrapped surfaces, without creasing.

2 Claims, 1 Drawing Sheet

METHOD FOR OVERWRAPPING PACKETS OF CIGARETTES

BACKGROUND OF THE INVENTION

The present invention relates to a method of overwrapping packets of cigarettes.

Packets of cigarettes are enveloped conventionally in an airtight overwrapping, fashioned from a sheet of transparent wrapping material, so that the cigarettes inside the packet remain isolated from the external environment.

To enable the manufacture of such outer wrappings, use is made of an overwrapping machine generally of the type comprising a first feed line along which packets are advanced singly and in succession, following a first path, a second feed line along which sheets of transparent wrapping material are directed singly and in succession following a second path, and, coinciding with a point where the first path crosses the second path, a folding station at which the single packets are brought into association with respective wrapping sheets. Use is also made of a guide extending along the first path beyond the folding station, providing an internal duct compassed between at least two parallel walls disposed transversely to the selfsame first path, one on either side, by which each successive sheet is constrained to fold around the respective packet and assume a profile of "U" shape, thus forming a partially open tubular wrapping.

With environmental concerns now forcing the adoption of thinner and thinner wrapping materials, however, a conventional machine as outlined above has certain drawbacks, associated not least with the mechanism by which the wrapping sheets are directed into the duct and caused to fold around the respective packets: in operation, the effect of friction generated between the sheet and the walls of the duct, which engage in contact with the sheet across its full width, is to crease the material in a direction parallel with the direction of movement of the packet, thus rendering the packet substandard and resulting in its rejection.

SUMMARY OF THE INVENTION

The object of the present invention is to provide a method of overwrapping packets of cigarettes such as will remain free of the drawbacks mentioned above, and allow overwrappings to be fashioned successfully from a relatively sheer wrapping material.

The stated object i s duly realized in a method of overwrapping packets of cigarettes according to the present invention, which comprises the familiar steps of directing packets singly and in succession along a first path, directing sheets of transparent wrapping material singly and in succession along a second path which crosses the first path at a folding station, associating each successive packet with a respective sheet at the folding station by bringing the packet into contact initially with a substantially central portion of the sheet, and then causing the sheet to fold around the packet and assume a profile of "U" shape with two lateral portions on each side of the central portion flattened against respective lateral faces of the packet. Advantageously, the method of the present invention comprises the further step of compressing a central band of each lateral portion when flattened against the respective lateral face of the packet, in such a way that the selfsame lateral portions are spread progressively and into uniform contact with the respective lateral faces. The method can be practical using a machine for overwrapping packets of cigarettes according to the present invention.

Such a machine comprises: first feed means by which packets are directed singly and in succession along a first path and second feed means by which sheets of transparent wrapping material are directed singly and in succession along a second path; a folding station located at a point where the first path crosses the second path, toward which the packets and the ralative sheets advance timed in relation to one another and in such a way that each packet is brought into contact initially with a substantially central portion of the relative sheet. Such a machine also includes hollow guide means located beyond the folding station and in alignment with the first path, providing a passage to the successive packets and relative sheets, by which each sheet is caused to fold around the respective packet and assume a profile of "U" shape with two lateral portions on either side of the central portion flattened against corresponding lateral faces of the packet.

In the machine disclosed, the guide means incorporate pressure means designed to interact selectively with a central band of each lateral portion presented by the successive sheets when flattened against the respective lateral face, in such a way that the selfsame lateral portions will be spread progressively and into uniform contact with the corresponding lateral faces.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
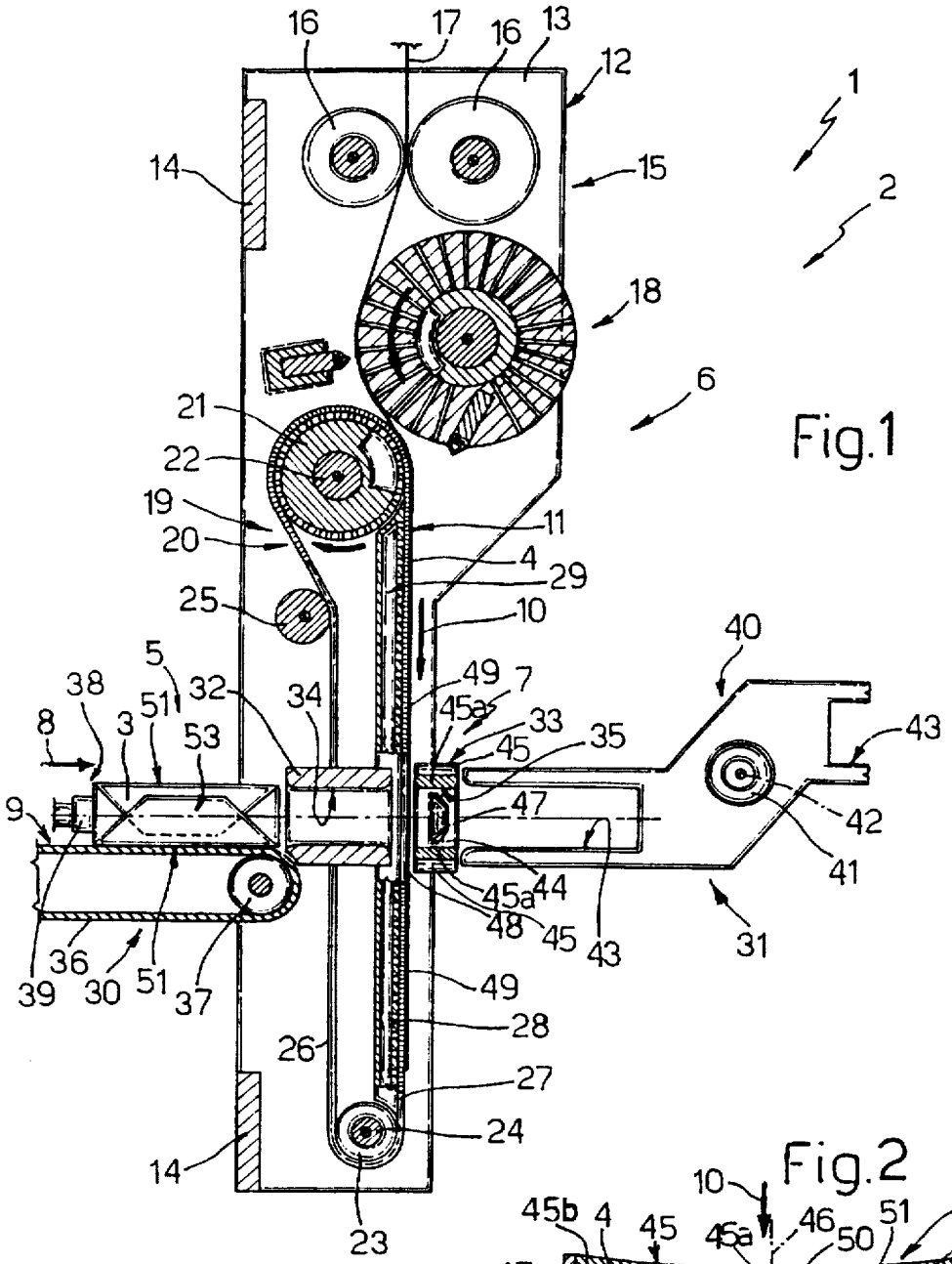
FIG. 1 illustrates a preferred embodiment of the machine for practicing the method according to the present invention, viewed in a side elevation with certain parts in section and certain omitted for clarity.

With reference to FIG. 1 of the drawings, the numeral 1 denotes a machine, in its entirety, of which a central section 2 is designed to overwrap packets 3 of cigarettes singly and in succession with respective sheets 4 of wrapping material.

The central section 2 comprises a first feed line 5 and a second feed line 6 along which the packets 3 and the sheets 4 are caused to advance, respectively, also a folding station 7 coinciding with a point at which the first feed line 5 crosses the second feed line 6. More exactly, the packets 3 are advanced in succession along the first feed line 5 in a direction 8 normal to their respective longitudinal axes, and following a first substantially rectilinear path 9 that crosses the second line 6 at the folding station 7, while the sheets 4 are advanced along the second feed line 6 in a direction denoted 10 following a second rectilinear path 11 that extends transversely to the first path 9 at the folding station 7, their progress timed with that of the packets 3 in such a way that each sheet 4 is engaged by a respective packet 3, folded into a "U" shape and directed away from the second feed line 6 onto the first feed line 5.

The second feed line 6 comprises a frame denoted 12, which constitutes a fixed part of the machine 1 and consists in two mutually parallel flank walls 13 (one only of which is indicated) extending along the second path 11 and on either side of both the paths 9 and 11, interconnected by a pair of cross members 14 disposed transversely to the second path 11, respectively above and below the first path 9.

The second feed line 6 further comprises a pinch roll feed device 15 mounted to a top part of the frame 12 and having a pair of rolls 16 disposed on opposite sides of the respective path 11, between and by which a continuous strip 17 of transparent sheet material is gripped and advanced toward the folding station 7. Also forming a part of the second feed line 6 is a first conveyor device 18, conventional in embodiment, supported by an intermediate portion of the frame 12 at a point along the second path 11 following the feed device 15, by which the strip 17 is taken up and cut transversely in familiar manner to generate the single sheets 4. Finally, the second feed line 6 comprises a second conveyor device 19 mounted to a bottom part of the fixed frame 12, by which the successive sheets 4 are taken up singly from the first conveyor device 18, indexed along the path 11 and brought to a halt at the folding station 7.

The second conveyor device 19 comprises two single and substantially identical belt conveyors 20 (one only of which is indicated) positioned within the compass of the frame 12, adjacent to the flank walls 13 and on either side of the path 11, at a distance one from the other marginally less than the width of one sheet 4. Each conveyor 20 comprises a power driven pulley 21 keyed to a drive shaft 22 positioned above the first path 9, extending transversely between the two flank walls 13 and rotatable clockwise as viewed in FIG. 1, also a pulley 23 keyed to a freely revolving shaft 24 supported rotatably between the walls 13, disposed parallel with and on the opposite side of the first path 9 from the first shaft 22, and a jockey pulley 25 mounted rotatably to the respective wall 13.

Tensioned between the two pulleys 21 and 23 of each conveyor 20 is a looped belt 26 embodied in a material permeable to air, of which an active branch 27 extends along the second path 11 through the folding station 7 and in contact with a pierced plate 28 that is also one wall of a suction chamber 29 mounted between the relative pulleys 21 and 23 and providing a pipeline (not illustrated) for connection to a conventional vacuum device not indicated in the drawings. The two belts 26 are spaced apart at a distance providing a passage such as will allow a packet 3 advancing along the first path 9 to cross the second feed line 6.

The first feed line 5 will be seen to comprise two conveyor devices 30 and 31 arranged in series along the feed path 9 respectively preceding and following the second feed line 6, hence the folding station 7, and two tubular guides 32 and 33 arranged likewise along the feed path 9. In particular, the one guide 32 is positioned between the first conveyor device 30 in sequence and the folding station 7, also between the two belt conveyors 20, and provides an internal duct 34 such as will allow the passage of a single packet 3, while the remaining guide 33 is located between the folding station 7 and the second conveyor device 31 in sequence, facing the active branches 27 of the looped belts 26 and providing an internal duct 35 designed to accommodate the passage of a packet 3 together with the relative sheet 4, thus causing the sheet 4 to fold around the packet 3 into a "U" formation as will be described in due course.

The conveyor device denoted 30 comprises a belt 36 looped around two pulleys 37 (one only of which is illustrated), also a push rod device 38 with an arm 39 capable of reciprocating along the first path 9, by which the packets 3 are distanced from the belt 36 and advanced singly and in succession through the ducts 34 and 35.

The conveyor device denoted 31 comprises a transfer wheel 40 keyed to a drive shaft 41 that is indexed in rotation about its own axis 42, following a clockwise direction as viewed in FIG. 1. The wheel 40 affords peripheral pockets 43, each of which rotatable through the folding station 7 and, when in alignment with the first path 9, designed to take up a packet 3 together with the respective sheet 4 folded into a U formation around the packet.

Figure 2:
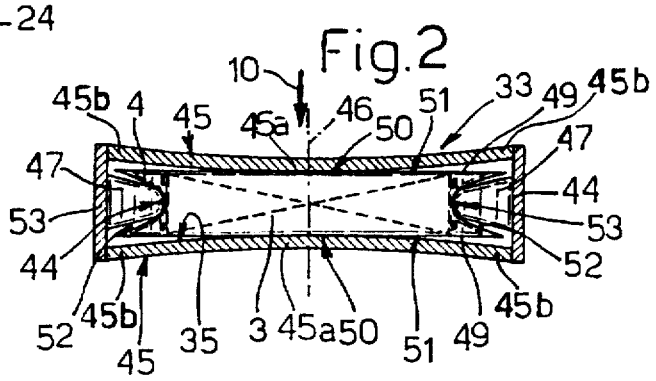
FIG. 2 is a detail of FIG. 1, illustrated in section.

As discernible from FIG. 2, the second tubular guide 33 in sequence is in effect a drawing die presenting two shorter side walls 44 disposed on either side of the second path 11, parallel with one another and with the corresponding feed direction 10, and spaced apart at a distance greater than the width of the single sheet 4, also two longer side walls 45 disposed transversely to the second feed direction 10 and combining with the shorter walls 44 to form the duct 35. In particular, the longer walls 45 are curvilinear in profile, with respective convex intermediate portions **45*a* disposed facing one another within the duct 35 and converging on a median axis 46 of the duct 35 in such a way that the distance separating the two convex portions 45*a* at this same axis 46 is substantially equal to the depth of one packet 3, and in such a way that the distance between two lateral portions 45*b* of the walls 45 near to the shorter walls 44 is greater than the depth of one packet 3. The shorter walls 44 present respective fold traps 47 projecting from the walls 44 into the duct 35** one toward the other.

The operation of the overwrapping machine 1 will now be described, commencing from the moment at which a pocket 43 of the wheel 40 is rotated into a position of alignment with the duct 35 along the first path 9, ready to receive a packet 3 together with the respective sheet 4. A sheet 4 is directed by the two conveyors 20 into the folding station 7 and brought to a halt with a substantially central portion 48 placed across the feed path 9, offered full face to the ducts 34 and 35, and with two lateral portions 49 on either side of the central portion 48 attached stably to the belts 26, retained by respective parts of the active branches 27 preceding and following the folding station 7. At this point, a packet 3 is directed forward by the arm 39 of the push rod device 38 toward the folding station 7.

As the packet 3 is pushed by the arm 39 through the first duct 34, the leading face enters into contact with the respective sheet 4, and more exactly with the central portion 48 which in consequence is separated from the belts 26. Still advancing, the arm 39 pushes the packet 3 into the second duct 35, with the result that the lateral portions 49 likewise are caused to separate from the belts 26 as the sheet 4 is forced into the duct 35 together with the packet.

As the packet 3 enters the duct 35, the sheet 4 will be folded into a U formation around the faces of the packet 3 by interaction with the longer side walls 45, of which only the convex intermediate portions **45*a* effectively make contact with the sheet 4, engaging respective central bands 50 of the respective lateral portions 49 and compressing these same bands against the larger faces 51 of the packet 3, in such a manner that the lateral portions 49** are spread gradually into full and uniform contact with the respective faces.

While the process of folding the sheet 4 around the packet is assisted by the lateral portions **45*b* of the walls 45, these do not in practice force the sheet 4 against the corresponding faces 51 of the packet 3: accordingly, one avoids the risk that creases could be generated in a direction substantially parallel to the direction of movement 8 of the packet 3 as the result of frictional contact between the elements 45*b* and 49 in question, which would in effect be the case if the side walls 45 were disposed mutually parallel and thus bound to engage the lateral portions 49** across their full width.

At the same time, the fold traps 47 enter into contact with two end portions 52 of the central portion 48, which continue to project beyond the packet 3 when the sheet 4 is engaged initially and caused to envelop the relative faces. The portions 52 in question are now bent square and flattened by the traps 47 against the respective smaller end faces 53 of the packet 3.

Thereafter, the partly overwrapped packet 3 is forced by the push rod device 38 fully into the pocket 43 of the conveyor wheel 40, and indexed by the wheel toward and through a successive station (not illustrated) at which further folding operations are performed on the sheet 4 in a conventional manner.

What is claimed is:

1. A method of overwrapping packets of cigarettes, comprising the steps of:

directing a plurality of packets singly and in succession along a first path;

directing a plurality of sheets of transparent wrapping material singly and in succession along a second path which crosses said first path at a folding station;

associating each successive said packet with a respective said sheet at said folding station by bringing the respective said packet into contact initially with a substantially central portion of the respective said sheet;

causing the respective said sheet to fold around the respective said packet and assume a profile of "U" shape with two lateral portions on each side of the respective said central portion flattened against respective lateral faces of the respective said packet;

compressing a central band of each said lateral portion when flattened against the respective lateral face of the respective said packet, in such a way that said lateral portions are spread progressively and into uniform contact with the respective said lateral faces; both longitudinally and transversally of the direction of movement of the respective said packet along said first path; each said packet lateral face having a transversal width which is larger than the transversal width of the respective said central band, said lateral portions as a result of said compressing not being compressed throughout the full width of the respective said lateral face.

2. The method as of claim 1, further comprising:

a folding step in which respective end portions of said central portion of the respective said sheet are flattened against respective end faces of the respective said packet.

* * * * *